US006907631B2

(12) United States Patent
Heaton

(10) Patent No.: US 6,907,631 B2
(45) Date of Patent: Jun. 21, 2005

(54) ADJUSTABLE PROFILING BEDS

(75) Inventor: Scott Paul Heaton, Halifax (GB)

(73) Assignee: Siddall & Hilton Limited, Halifax (GB)

( * ) Notice: Subject to any disclaimer, the term of this patent is extended or adjusted under 35 U.S.C. 154(b) by 0 days.

(21) Appl. No.: 10/406,478

(22) Filed: Apr. 3, 2003

(65) Prior Publication Data

US 2003/0208845 A1 Nov. 13, 2003

(30) Foreign Application Priority Data

Apr. 5, 2002 (GB) ..... 0207886
Jan. 29, 2003 (GB) ..... 0302038

(51) Int. Cl.[7] ..... A61G 7/015
(52) U.S. Cl. ..... 5/618; 5/617; 5/616; 5/613
(58) Field of Search ..... 5/618, 617, 616, 5/613, 611

(56) References Cited

U.S. PATENT DOCUMENTS

| | | | | |
|---|---|---|---|---|
| 3,222,693 A | | 12/1965 | Pruim et al. | |
| 4,258,445 A | * | 3/1981 | Zur | 5/614 |
| 4,821,351 A | * | 4/1989 | Bergenwall | 5/618 |
| 5,245,718 A | * | 9/1993 | Krauska | 5/618 |
| 5,402,544 A | * | 4/1995 | Crawford et al. | 5/616 |
| 5,544,375 A | * | 8/1996 | Urness et al. | 5/611 |
| 6,006,379 A | | 12/1999 | Hensley | |
| 6,138,303 A | * | 10/2000 | Alvestad | 5/618 |
| 6,276,011 B1 | * | 8/2001 | Antinori | 5/618 |
| 6,343,392 B1 | * | 2/2002 | Becker et al. | 5/618 |
| 6,494,538 B1 | * | 12/2002 | Alvestad | 5/618 |
| 6,584,629 B2 | * | 7/2003 | Tsuji et al. | 5/618 |
| 6,643,873 B2 | * | 11/2003 | Heimbrock et al. | 5/618 |

FOREIGN PATENT DOCUMENTS

| | | |
|---|---|---|
| DE | 1262529 | 3/1968 |
| DE | 20000700 | 4/2000 |
| FR | 1270426 | 8/1961 |
| WO | WO 0051469 | 9/2000 |

* cited by examiner

*Primary Examiner*—Frederick L. Lagman
(74) *Attorney, Agent, or Firm*—Trexler, Bushnell, Giangiorgi, Blackstone & Marr, Ltd.

(57) ABSTRACT

The invention relates to profiling beds where sections of the bed can be raised or lowered for the benefit and comfort of the user of the bed. The object of the invention is to prevent a compression of the lower stomach of the user as sections of the bed are raised, an objective met by a construction comprising at least a head and upper body support hingedly connected to a frame, a seat support hingedly connected to the head and upper body support at one end and to the frame at the other, the hinged connections being such that as the head and upper body support is raised about its hinged connection to the base, the seat portion is lowered about its hinged connection to the frame, and the distance between said hinged connections in the longitudinal direction of the bed increasing as the said sections are simultaneously raised and lowered. The object of the invention is further met by a construction comprising at least a head and upper body support hingedly connected to a frame, a seat support and a thigh and lower leg support, the seat support being hingedly connected to the adjacent end of the thigh support and hingedly connected to the frame, the hinged connections being such that as thigh support is raised about its hinged connection to the frame, the end of the seat support hingedly connected to the thigh support is lowered, the distance between those hinged connections in the longitudinal direction of the bed increasing as the said thigh support and seat support are respectively simultaneously raised and lowered.

11 Claims, 8 Drawing Sheets

ADJUSTABLE PROFILING BEDS

This invention relates to adjustable profiling beds particularly, but not necessarily exclusively, for use by invalids or by persons recovering from accidents or surgery.

Adjustable profiling beds are known where separate sections of the bed are separately adjustable as can be required for both medical purposes and for patient comfort. Thus, it is known for a head and upper body section to be adjustable from a horizontal position where the user is in a prone position to a required angle of inclination to raise the head and upper body. Also, known is an ability to adjust the section supporting the upper and lower leg portions to put the legs in a desired disposition.

When the head and upper body portion is simply hinged to the section of the bed supporting the seat of the user, lifting and lowering of the head and upper body section of the bed can be to the considerable discomfort of the user. There is an inevitable compression of the lower stomach and lower back area of the user, as the head and upper body is raised. There is also a relative movement between the bed, and more particularly a mattress laid on the said sections, and the user, causing patient movement down the bed. Patients then have to be re-positioned to regain comfort.

This has led to constructions where the seat section is caused to move to an opposite angled position to that of the head and upper body as it is raised. This is of some assistance in preventing a relative movement between the bed/mattress and the user, but does not eliminate that problem, and does not attend to the problem of compression of the lower stomach area of the user.

Similar considerations apply in the circumstance where the requirement of a user is for the upper body to be kept flat, but the thigh and lower leg raised to an angle/elevated condition. This is known to be achieved by simply pivotally connecting a thigh and lower leg support to a bed frame, but that is not conducive to the total comfort of the user.

The object of the present invention is to provide an adjustable profiling bed that assists considerably in avoiding those problems discussed above.

According to a first aspect of the present invention, an adjustable profiling bed comprises at least a head and upper body support hingedly connected to a frame, a seat support hingedly connected to the head and upper body support at one end and to the frame at the other, the hinged connections being such that as the head and upper body support is raised about its hinged connection to the base; the seat portion is lowered about its hinged connection to the frame, and the distance between said hinged connections in the longitudinal direction of the bed increasing as the said sections are simultaneously raised and lowered.

According to a second aspect of the present invention, an adjustable profiling bed comprises at least a head and upper body support hingedly connected to a frame, a seat support and a thigh and lower leg support, the seat support being hingedly connected to the adjacent end of the thigh support and hingedly connected to the frame, the hinged connections being such that as thigh support is raised about its hinged connection to the frame, the end of the seat support hingedly connected to the thigh support is lowered, the distance between those hinged connections in the longitudinal direction of the bed increasing as the said thigh support and seat support are respectively simultaneously raised and lowered.

Thus, during its movement to its raised position the lower end of the head and upper body support moves in a rearward direction, with the result that a compression of the lower stomach area of the user is substantially prevented. Also prevented is a relative movement between a mattress on the supports and the user thereby preventing the patient moving down the bed and forcing comfort repositioning.

To allow the lower end of the head and upper body support to move downwardly and rearwardly during the raising of that section, its hinged connection to the frame is positioned part way along its side edges, and the seat support is on extendible support members hinged at one end to the lower end of the head and back support, and at the other to the frame. Preferably, the extendible support members are of telescopic construction.

Similarly, to allow the lower end of the thigh support to move downwardly and forwardly during the raising of that section, its hinged connection to the frame is positioned part way along its side edges, and its lower end is hingedly connected to the adjacent ends of the extendible support members of the seat support.

To cause the required degree of movement of the head and upper body support and of the thigh support, and opposite movement of the seat support, hydraulic, electrical or mechanical actuators may be mounted below the bed frame, with extendible actuator rods extending to a pivotal attachment to the lower edge of the head and upper body support, and thigh support respectively. Preferably the seat support is located on support members of telescopic construction, pivotally attached by one end to the lower end of the head and back support and pivotally attached by the opposite end to the lower end of the thigh support.

For the greater comfort of the user and for some medical requirements, there may be, in addition to the thigh support hingedly connected to the frame, a lower leg support hingedly connected to the thigh support. Thus the thigh support can be raised about its pivotal connection to the frame, to generate a V-shape with the lower leg support to elevate the knees of the user. Also possible is the provision of bracing rods pivotally connected to the frame and to the remote end of the lower leg support, such that as the thigh support is raised about its pivotal connection to the frame, the lower leg support is raised but kept parallel to the bed frame.

In addition to the above, opposite ends of the bed can be raised and lowered, to lower the bed height as a whole for ease of access by the user, and raise the bed as a whole for the convenience of a carer attending on a user of the bed. The ends of the bed may be separately adjustable, so that the user in a prone position can be set at an angle with either the head or the feet raised. To allow this, further actuators, hydraulic, electric or mechanical can be provided between a support member for the frame and the frame, to allow the frame to be raised and lowered.

Thus, the support members for the actuator may be attached to a cross member extending between legs in telescopic connection with tubular side members on the bed head and bed foot.

One embodiment of the invention will now be described with reference to the accompanying drawings in which.

Figure 1:
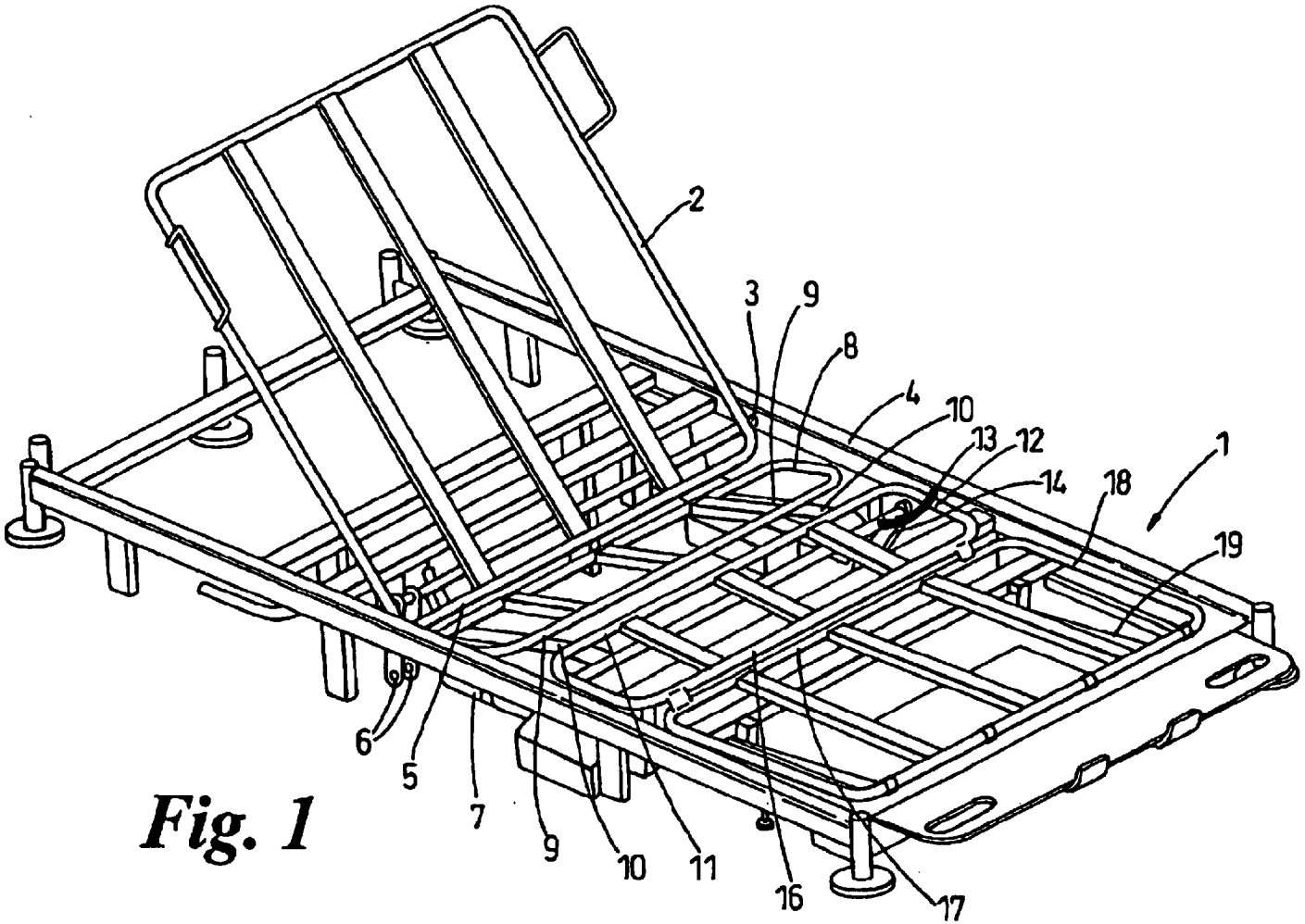
FIGS. 1 and 2 are perspective views of an adjustable profiling bed frame with parts removed for clarity, with the body support and thigh support respectively in raised condition.

In the drawings an adjustable profiling bed 1 has a head and upper body support 2 with a pivotal connection 3 to a frame 4 distanced from an edge 5, the pivot having connecting arms 6 for attachment to the rod of an electrical actuator 7, secured to the frame.

A seat support 8 is located on parallel telescopic supports 9, 10, the outer members 9 being pivotally attached to the edge 5 of the head and body support 2, and the inner members 10 being pivotally attached to the adjacent edge 11 of a thigh support 12.

The thigh support 12 is pivotally attached at 13 to the frame 4, and dependant from the pivot are connecting arms 14 for attachment to an actuator 15, the rod of which is pivotally connected to the arms and the cylinder and drive motor attached to the frame.

To the opposite end 16 of the thigh support 12 is pivotally attached the adjacent end 17 of a lower leg support 18 that is free to be raised and lowered with respect to the frame 4, and has bracing arms 19 pivotally attached to the frame 4, and detachably and pivotally attached to the lower leg support.

Although not shown, the actuators are suitably connected to a source of electrical Although not shown, the actuators are suitably connected to a source of electrical power, and a hand set is provided with an electrical cable extending to a control unit on the profiling bed in turn connected to the actuators.

From the prone position of all supports, adjustment can be made at will by the occupant of the bed or by an attendant, and to a degree required by the occupant.

Figure 2:
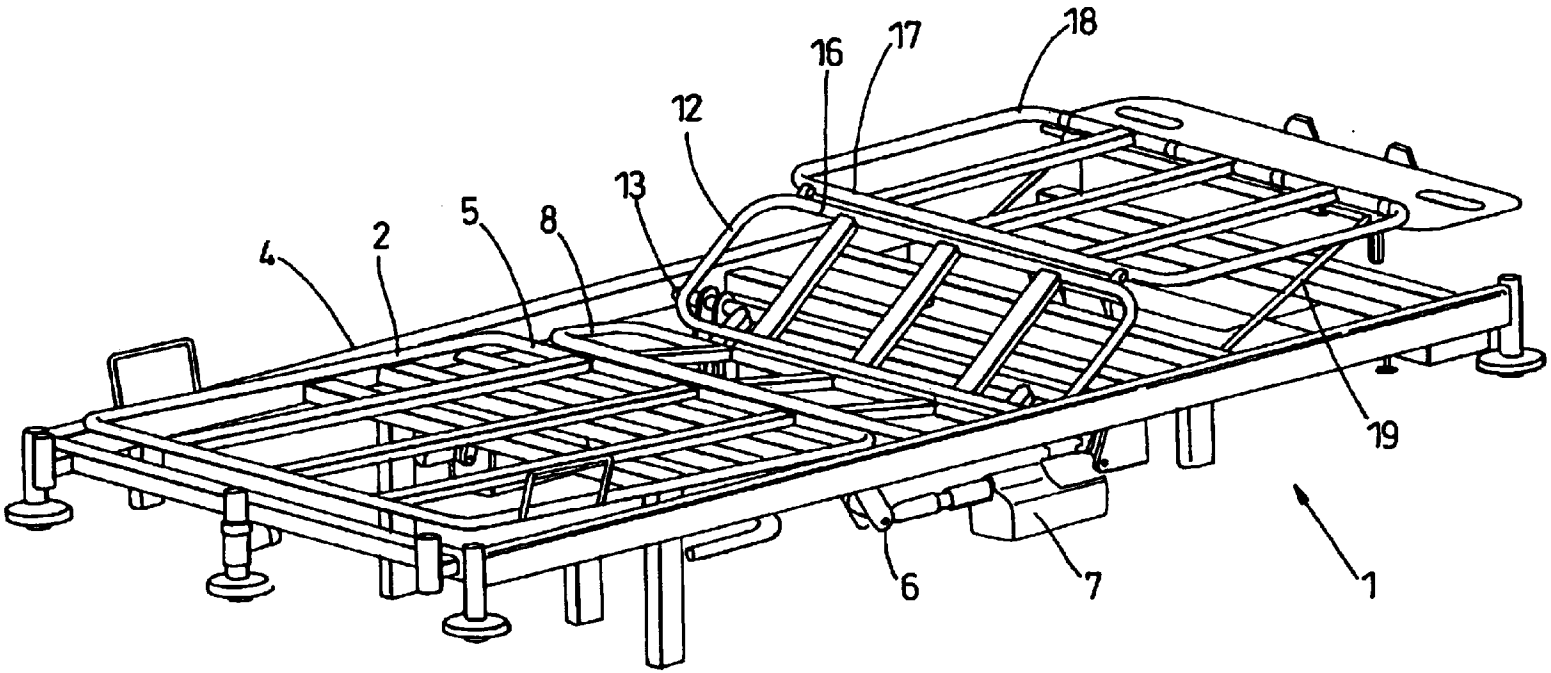
Figure 3:
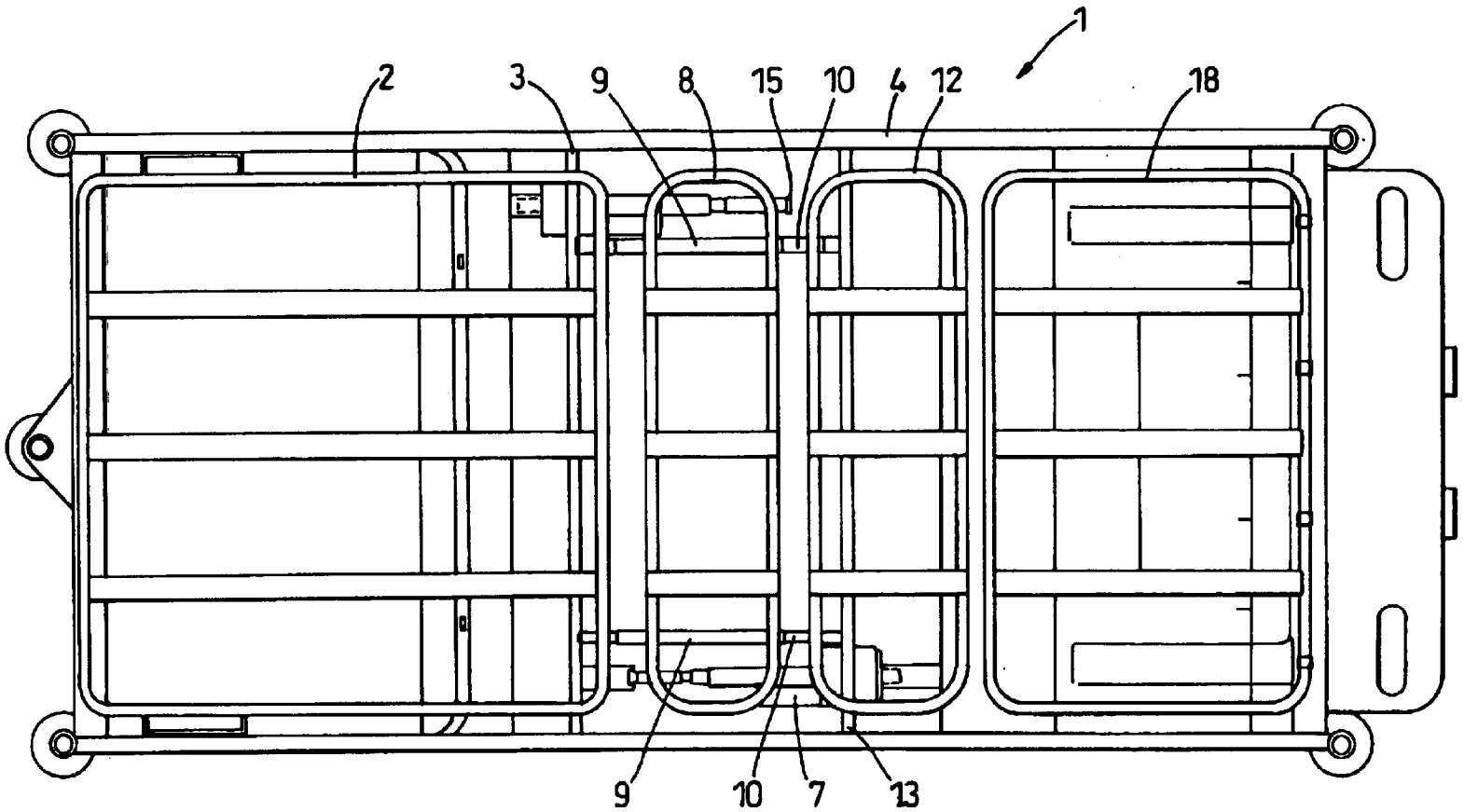
FIG. 3 is a plan view of the bed frame of FIG. 1, with the support sections flat.
Figure 4:
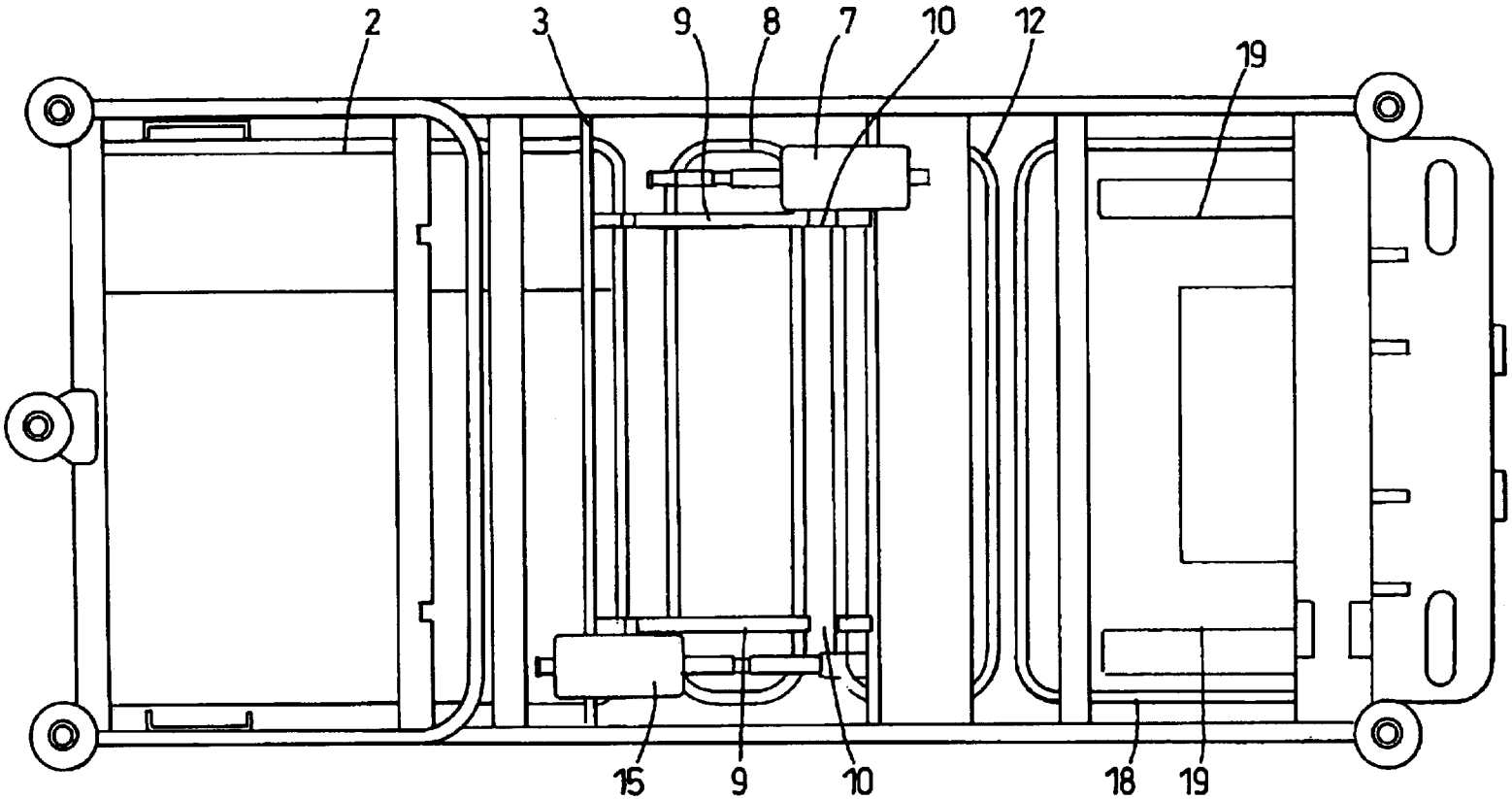
FIG. 4 is an underneath plan view of FIG. 3.
Figure 5:
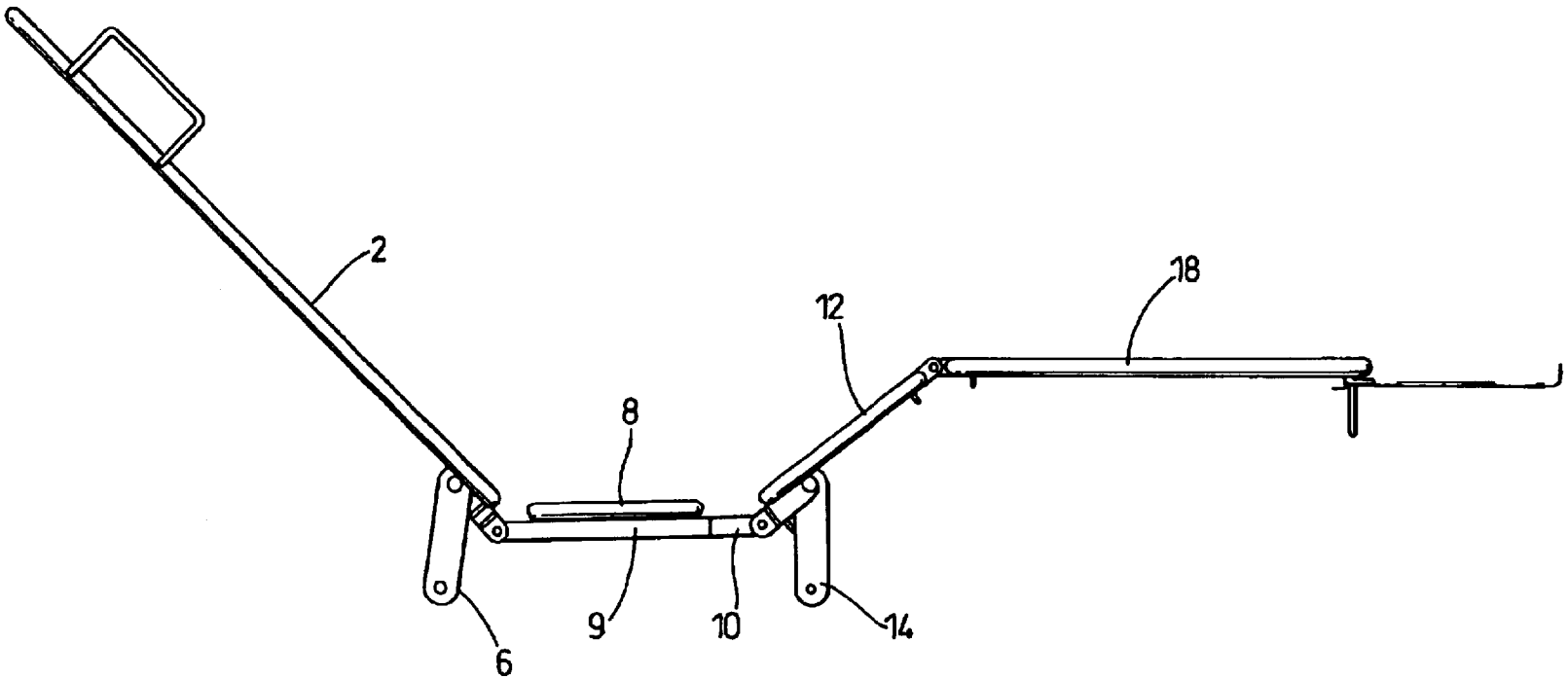
FIGS. 5 to 8 are side elevations of the support sections, with other parts of the bed frame removed for clarity, and illustrating examples of the positions that can be assumed by the body, seat, thigh and lower leg supports.

Thus, as is shown in FIG. 1, the head and upper body support 2 can be pivoted about its pivotal connection 3 by activating the actuator 7. As an automatic consequence of the raising of the head end of the support 2, its edge 5 is caused to lower and move rearwardly of the bed with a consequent extending of the telescopic supports 9 and a lowering of the adjacent edge of the seat support, as is illustrated in FIG. 5. As a consequence of this one end of the seat support 8 is lowered and a compression of the lower stomach area of the occupant of the bed is substantially prevented. Also prevented is relative movement of a mattress on the supports and the occupant preventing any movement of the occupant down the bed with ruckling of his/her bed clothes and enforced comfort repositioning. As is illustrated in FIG. 2, the head and body support 2 can be left flat and the thigh support 12 raised. Here the actuator 15 is activated to rotate the pivot 13, the consequence of which is that the telescopic supports 9, 10 are extended and the edge 11 of the thigh support is lowered and moved rearwardly of the bed. Here again there is a consequent lowering of the opposite end of the seat support 8, again to prevent any crushing effect on the lower stomach area of the occupant of the bed, and to prevent any sliding of the occupant over the mattress on the supports, and hence prevent ruckling of bed clothes and enforced comfort repositioning.

In FIG. 2, the bracing arms 19 are left connected, the result of which is that the lower leg support is raised and kept parallel to the bed frame.

To illustrate combinations of movements available reference is made to FIGS. 5 to 8.

In FIG. 5, the head and body support has been raised by the actuator 7 acting on the arms 6 and the thigh support raised by the actuator 15 acting on the arm 14. The bracing rods 19 although not shown are left connected to the lower leg support and as a consequence the leg support is raised to a position parallel to the bed base.

Figure 6:
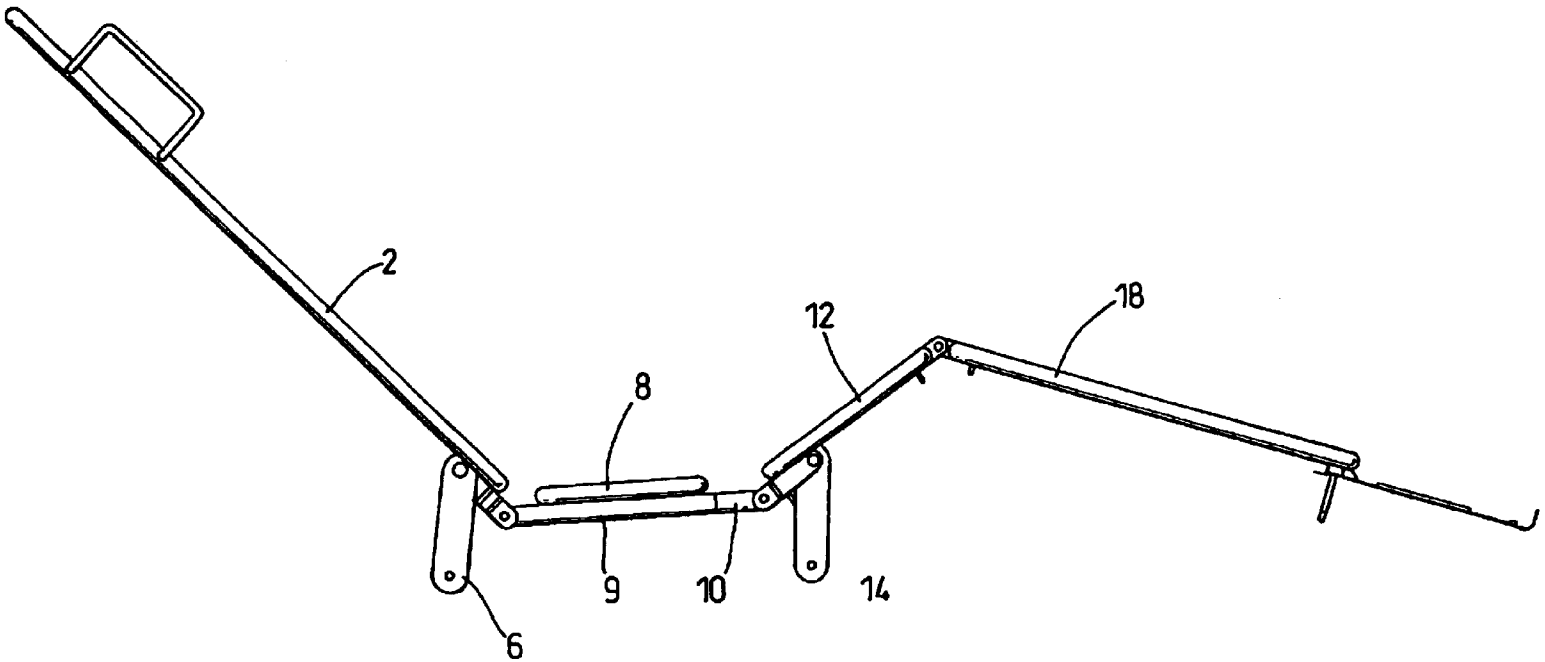

In FIG. 6, the head and body support 2 and the thigh support 12 are again raised but here, the bracing rods are disconnected from the lower leg support, causing the foot end of the lower leg support to rest on the bed frame as the pivot between the thigh support and lower leg support is raised.

Figure 7:
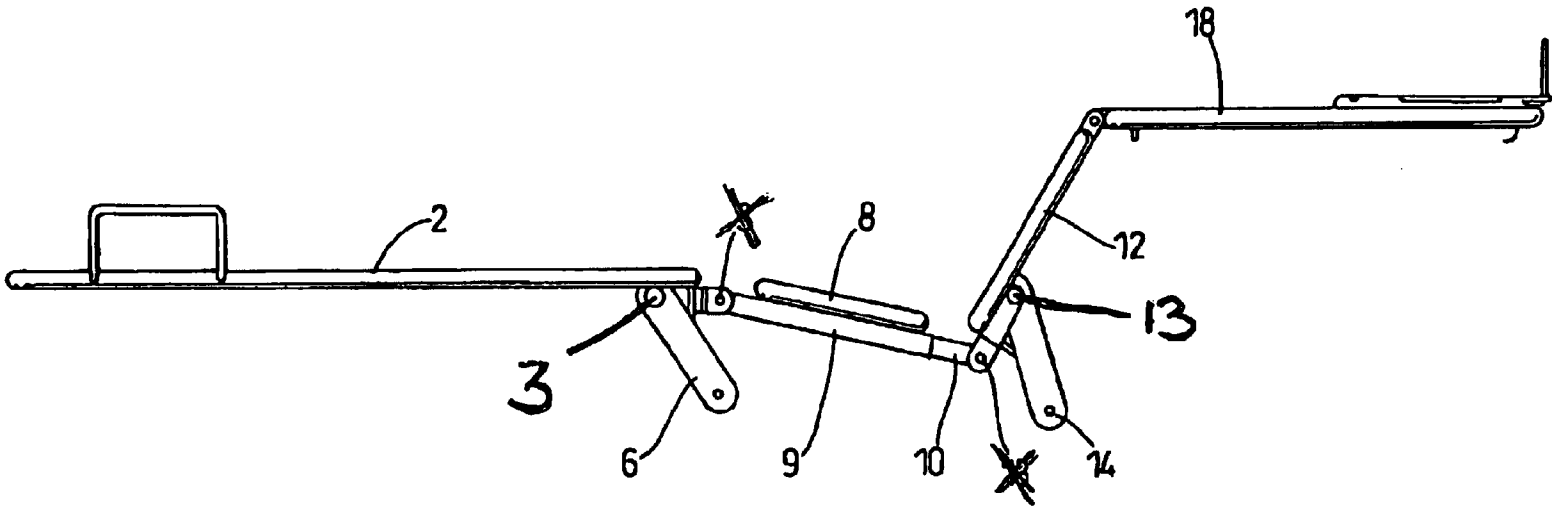

In FIG. 7, the head and body support 2 is left flat and the thigh support 12 is raised, causing the seat support 8 to be lowered about the its pivotal connector to the head and body support, and the telescopic supports 9, 10 to extend for the comfort of the user of the bed. Here, the braces 19 are left connected to cause the lower leg support to rise.

Figure 8:
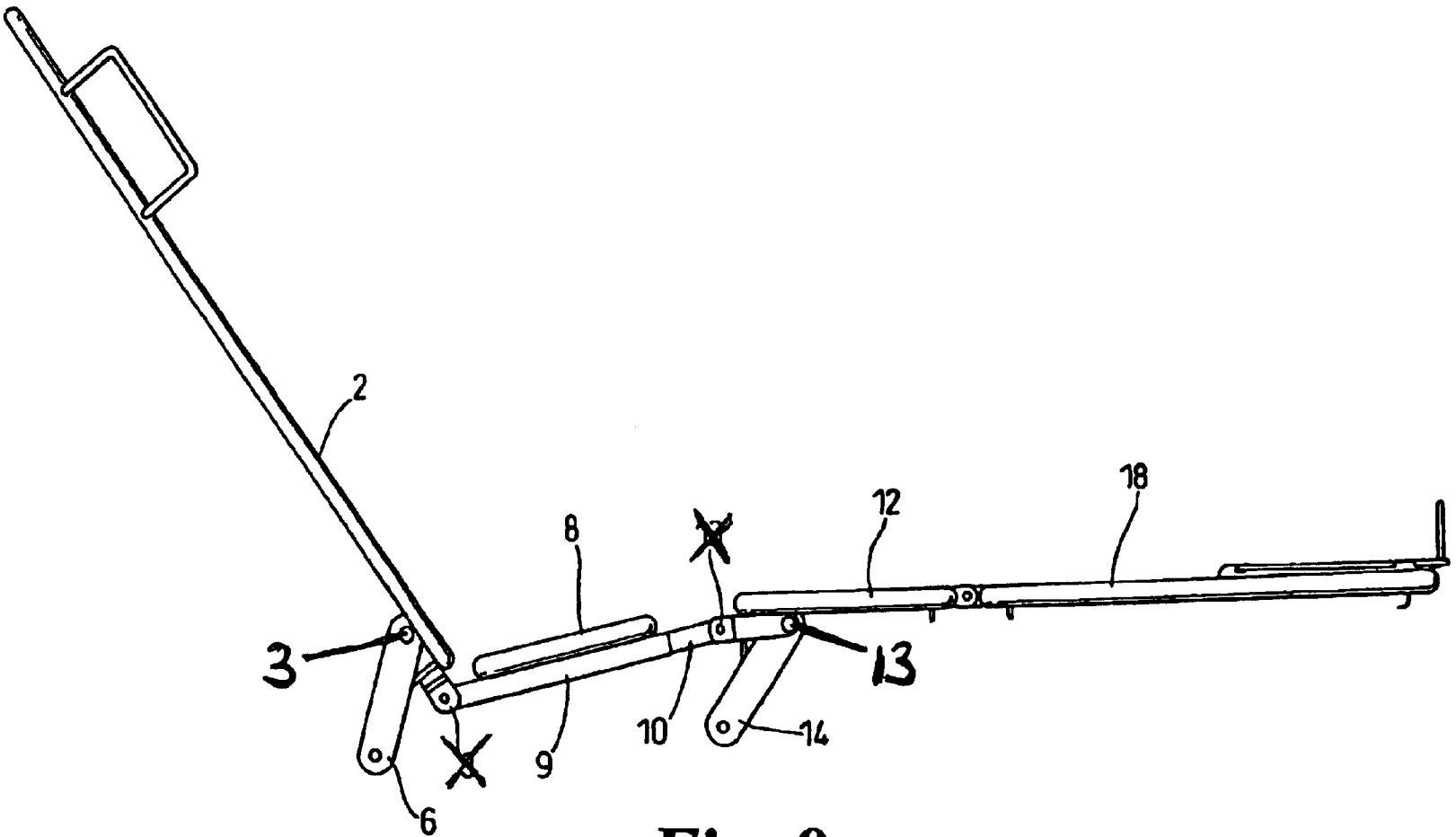

In FIG. 8, the head and body support is raised about the pivot 3 to cause the seat support 8 to lower about the its pivotal connector to the thigh support with the telescopic supports 9, 10 extending for the comfort of the user of the bed.

What is claimed is:

1. An adjustable profiling bed characterised by at least a head and upper body support hingedly connected to a frame, a seat support hingedly connected at both ends wherein one end of the seat support is hingedly connected to the head and upper body support, the hinged connections being such that as the head and upper body support is raised about its hinged connection to the frame, the seat support lowers relative to the frame, and the distance between said hinged connections of the seat support in the longitudinal direction of the bed increases, and wherein as the head and upper body support is lowered about its hinged connection to the frame, the seat support raises relative to the frame, and the distance between said hinged connections of the seat support in the longitudinal direction of the bed decreases.

2. An adjustable profiling bed as in claim 1 and characterised by at least a head and upper body support hingedly connected to a frame, a seat support and a thigh and lower leg support, the seal support being hingedly connected to the adjacent end of the thigh support and hingedly connected to the frame, the hinged connections being such that as thigh support is raised about its hinged connection to the frame, the end of the seat support hingedly connected to the thigh support is lowered, the distance between those hinged connections in the longitudinal direction of the bed increasing as the said thigh support and seat support are respectively simultaneously raised and lowered.

3. An adjustable profiling bed as in claim 1 or claim 2, characterised in that during its movement to its raised position the lower end of the head and upper body support moves in a rearward direction.

4. An adjustable profiling bed as in claim 3 characterised in that to allow the lower end of the head and upper body support to move downwardly and rearwardly during the raising of that section, its hinged connection to the frame is positioned part way along its side edges, and the seat support is on extendible support members hinged at one end to the lower end of the head and back support, and at the other to the frame.

5. An adjustable profiling bed as in claim 4 characterised in that the extendible support members are of telescopic construction.

6. An adjustable profiling bed as in claim 2 characterised in that to allow the lower end of the thigh support to move downwardly and forwardly during the raising of that section, its hinged connection to the frame is positioned part way along it side edges, and its lower end is hingedly connected to the adjacent ends of the extendible support members of the scat support.

7. An adjustable profiling bed as in claim 1 characterized in that to cause the required degree of movement of the head and upper body support and of the thigh support, and opposite movement of the seat support, hydraulic, electrical or mechanical actuators may be mounted below the bed frame, with extendible actuator rods extending to a pivotal attachment to the lower edge of the head and upper body support, and thigh support respectively.

8. An adjustable profiling bed as in claim 1 characterised in that the seat support is located on support members of telescopic construction, pivotally attached by one end to the lower end of the head and back support and pivotally attached by one end to the lower end of the head and beck support and pivotally attached by the opposite end to the lower end of the thigh support.

9. An adjustable profiling bed as in claim 1 characterised in that a lower leg support is provided, hinged to the thigh support.

10. An adjustable profiling bed as in claim 9 characterised in that bracing rods are provided pivotally connected to the frame and detachably attached to the remote end of the lower leg support.

11. An adjustable profiling bed as in claim 1 wherein hydraulic, electric or mechanical actuators are provided to allow one or both ends of the bed to be raised and lowered.

* * * * *